United States Patent [19]

Sakharoff

[11] 4,190,989

[45] Mar. 4, 1980

[54] ROOF FLASHING SYSTEM

[76] Inventor: Albert Sakharoff, 13421 Cheltenham Dr., Sherman Oaks, Calif. 91429

[21] Appl. No.: 960,960

[22] Filed: Nov. 15, 1978

[51] Int. Cl.[2] ..... E04D 1/36

[52] U.S. Cl. ..... 52/60; 52/741

[58] Field of Search ..... 52/58–62, 52/218, 219, 741

[56] References Cited

U.S. PATENT DOCUMENTS

| | | | |
|---|---|---|---|
| 3,241,272 | 3/1966 | Edwards | 52/60 |
| 3,246,433 | 4/1966 | Eriksson | 52/60 |
| 3,668,811 | 6/1972 | Pollard | 52/60 |
| 4,004,381 | 1/1977 | Pichler et al. | 52/60 |

FOREIGN PATENT DOCUMENTS

| | | | |
|---|---|---|---|
| 292679 | 9/1966 | Australia | 52/60 |

*Primary Examiner*—James L. Ridgill, Jr.
*Attorney, Agent, or Firm*—Freilich, Hornbaker, Wasserman, Rosen & Fernandez

[57] ABSTRACT

A roof flashing system providing first and second parallel troughs for containment of a caulking compound. More specifically, the invention provides a first reglet which is attachable to a wall and which forms a longitudinally extending trough in conjunction with the wall for containment of a caulking compound and a second reglet attachable to the first reglet and forming a second longitudinally extending trough in conjunction with the wall for containment of a caulking compound, the second trough being located above and substantially parallel to the first trough. Thus, upon attachment of the first reglet to the wall, a first caulking bead is formed in the first trough providing a seal between the first reglet and the wall, the bead being shaped and inspected as it is formed. The second reglet is then attached to the first reglet and forms the second trough. A second caulking bead is then formed in the second trough, the second bead being substantially horizontal and parallel with the first bead. The invention also provides an attachment means for attaching a counterflashing strip to the first and second reglet combination, one edge of which is held to the combination and the other edge of which rests against the side of a roofing material whose edges are to be protected.

11 Claims, 2 Drawing Figures

ROOF FLASHING SYSTEM

FIELD OF THE INVENTION

The invention relates to flashing systems, such as are used in the construction of roofs, to prevent seepage of water from vertical or inclined walls into the space underneath roofing materials that partially cover these walls.

BACKGROUND OF THE INVENTION

Various flashing systems for preventing seepage beneath roofing materials are known in the art. Typically, such systems consist of a single reglet extrusion which is fastened to a wall either by retaining nails or screws. These single reglet systems conventionally provide one or two caulking channels which are formed between the reglet and wall. In addition, a counterflashing is typically provided, the counterflashing being connected at one edge of the reglet with the other edge resting against the edges of the roofing material to be protected. As one can appreciate, a reglet providing for two continuous caulking beads will provide in most instances a superior seal to a reglet providing only one continuous bead, the difference being that any moisture seeping between the first caulking bead and the wall will also have to pass between the second caulking bead and the wall prior to reaching the material to be protected.

Although some conventional flashing systems have provided for two caulking beads, the beads are typically formed by a single reglet which is configured to provide two longitudinally extending cavities each containing a caulking compound. Attachment of the reglet to the wall provides sufficient pressure for forming the caulking beads between the reglet and the wall. A problem encountered with this type reglet for forming the two beads is that the lower bead is formed only by the pressure of the reglet against the caulking material and the wall whereas the upper bead can be formed by direct pressure on the caulking material by an installing craftsman. In addition, the upper bead can be inspected by the craftsman after its formation. Thus, the top bead generally forms a satisfactory seal against the wall whereas the quality of the seal formed by the lower bead is somewhat fortuitous. Thus as one can appreciate, a two caulking bead seal formed by conventional flashing systems does not have the sealing characteristics as could be obtained if both seals could be independently formed and examined by the installing craftsman. Conventional reglet systems do not allow this independent formation and examination.

SUMMARY OF THE INVENTION

The present invention solves the above problems by providing a roof flashing system and method in which a first caulking bead can be formed and inspected prior to formation of a second caulking bead. The invention provides a first reglet which is attachable to a wall and forms a first longitudinally extending trough in conjunction with the wall for containment of a caulking compound. A second reglet is provided which is attachable to the first reglet and forms a second longitudinally extending trough in conjunction with the wall for containment of a caulking compound, the second trough being located above and substantially parallel to the first trough formed by the first reglet. In use, the first reglet is attached to a wall and the first caulking bead is formed in the trough formed by the first reglet and the wall. This caulking bead is shaped and compressed to form a tight seal between the reglet and the wall. Subsequent to formation at the first caulking bead, the second reglet is attached to the first reglet, the second reglet forming the second trough. Caulking compound is then placed in the second trough and a caulking bead formed in a manner similar to formation of the first caulking bead. Thus as one can appreciate, two caulking beads have been formed, each one being formed in the same manner as the other. However, the first caulking bead can be examined prior to formation of the second caulking bead and any air pockets or separation from the wall can be eliminated prior to formation of the second caulking bead. The invention further provides a counterflashing which is attachable to the first and second reglet combination. Thus the two reglet flashing system according to the present invention provides a means for forming two caulking beads having a sealing integrity not readily attainable with conventional roof flashing systems.

DETAILED DESCRIPTION

As required, detailed illustrative embodiments of the invention are disclosed herein. These embodiments exemplify the invention and are currently considered to be the best embodiments for such purposes. However, it is to be recognized that other means for attaching the second reglet to the first reglet, for attaching the counterflashing to the first and second reglet combination, and for forming the first and second troughs in the first and second reglets, respectively, could be utilized. Accordingly, the specific embodiments disclosed are representative in providing a basis for the claims which define the scope of the present invention.

As previously explained, the invention provides a roof flashing system comprising a first reglet attachable to a wall and which forms a longitudinally extending trough in conjunction with the wall for containment of a caulking compound. A second reglet is also provided, the second reglet being attachable to the first reglet and forming a second longitudinally extending trough in conjunction with the wall, the second trough being located above and substantially parallel to the first trough. A caulking bead is first formed in the first trough thereby providing a first seal to the wall. The second reglet is then attached to the first reglet and a caulking bead formed in the second trough, thereby providing a second seal to the wall. The invention also provides a longitudinally extending counterflashing which attaches to the first and second reglet combination and extends downwardly making abutting contact with a roofing or sidewall material.

Figure 1:
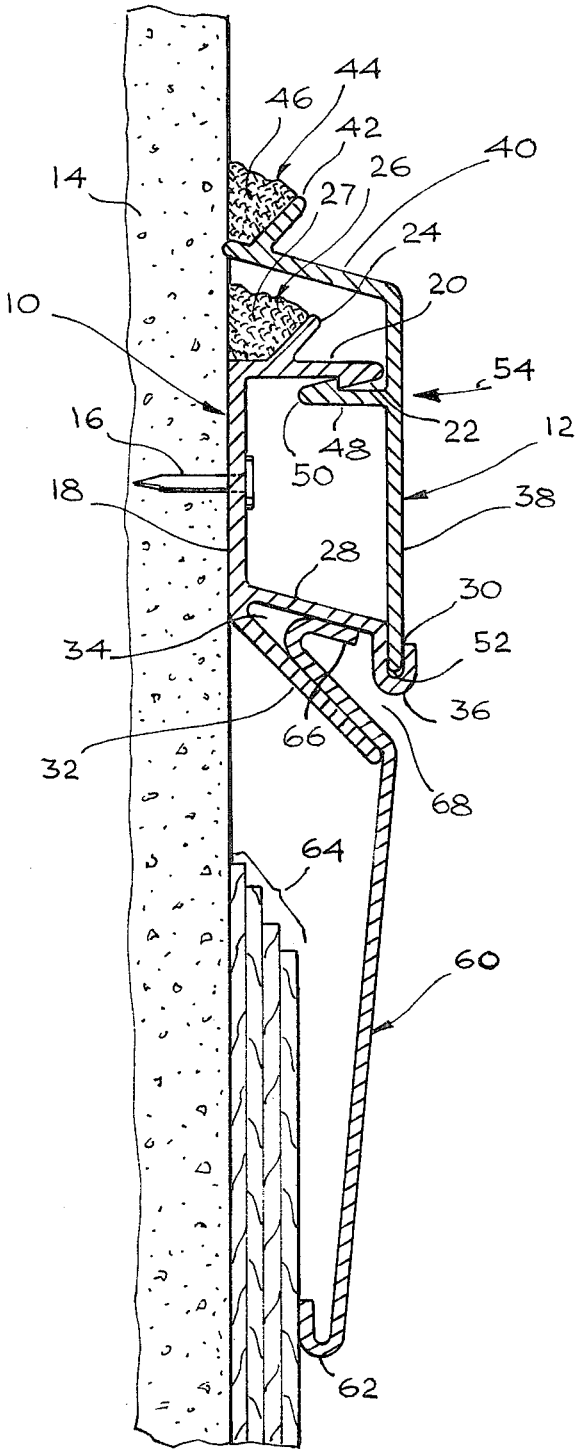
FIG. 1 is a cross-sectional view of a flashing system according to a first embodiment of the present invention.

Referring to FIG. 1, a first reglet 10 and a second reglet 12 are provided, each reglet being formed of a longitudinally extending extrusion. The first reglet 10 is attached to a wall by a holding nail 16, although a screw or any other type of suitable holding means could be utilized. The reglet 10 comprises a vertical section 18 having an outward extending upper flange 20, the outer edge of which is formed into the shape of an overhanging lip 22. A rib 24 extends upwardly from the upper surface of the upper flange 20 and forms in conjunction with the upper flange 20 and the wall 14 a first trough 26. Shown within the first trough 26 is a caulking compound as shown at 27, the purpose of which will be explained below. At the lower edge of the vertical section 18 is a lower flange 28 which extends outwardly and slightly downwardly and forms a groove 30 at its unconnected edge. A retaining flange 32 is also formed at the lower edge of the vertical section 18, the retaining flange 32 and lower flange 28 forming a longitudinally extending retaining channel 34. In this first embodiment, the lower flange 28 in forming the groove 30 also forms a downwardly extending retaining ridge 36, the purpose of which will be explained below.

The second reglet 12 consists of a vertical member 38, the upper edge of which is attached to an inwardly extending top flange 40. The top flange 40, in conjunction with a rib 42 extending upwardly therefrom and the wall 14, defines a second trough 44 for containment of a caulking compound as shown at 46. A medial flange 48 extends inwardly from the inner surface of the vertical member 38 and forms at its unconnected end an overhanging lip 50 which is adapted to make interlocking contact with the overhanging lip 22 of the first reglet 10. The lower edge 52 of the vertical member 38 is adapted to be received by the first reglet groove 30. A slight pressure on the vertical member 38, as shown by the vector at 54, will cause the second reglet overhanging lip 50 to make interlocking contact with the first reglet overhanging lip 22, thereby resulting in the top flange 40 unconnected edge being in abutting contact with the wall 14. As one can appreciate, the medial flange 48 is vertically located with respect to the vertical member 38 so that when its lower edge if disposed within the groove 30, the slight inward pressure shown at 54 will cause a slight deformity in the medial flange 48, thereby providing the interlocking action previously described. However as one can appreciate, other means of locking the second reglet 12 to the first reglet 10 could be utilized, one example being repositioning the medial flange 48 so that it extends inwardly above the upper flange 20 and reversing the respective overhanging lips 22 and 50.

A longitudinally extending counterflashing 60 is also provided, the lower edge 62 forming a lower lip which makes abutting contact with a roofing material to be protected as shown at 64. The upper edge of the counterflashing 60 is formed into a lip 66, the lip 66 being formed of a resilient material. The retaining ridge 36 and the retaining flange 32 forms a gap as shown at 68 which is sufficiently narrow so that the counterflashing lip 66 must be deformed somewhat to pass therethrough. Once having passed therethrough, the retaining ridge 36 prevents the counterflashing lip 66 from leaving the retaining channel 34.

In use, the first reglet 10 is attached to the wall 14 by a plurality of holding nails 16 appropriately spaced apart along the longitudinal length of the first reglet 10. Upon having attached the first reglet 10 to the wall 14, the caulking compound 27 is packed into the first trough 26 formed by the wall 14, the upper flange 20, and the rib 24. The purpose of this step is to provide a first seal between the flashing system and the wall. The second reglet 12 is then positioned so that its lower edge 52 is disposed within the lower flange groove 30. The second reglet 12 is then attached to the first reglet 10 by pressure as shown by the vector 54 as previously explained. Once in an attached configuration, the top flange 40 unconnected edge is in abutting contact with the wall 14 and forms the second trough 44. The caulking compound 46 is then packed into the second trough 44 thereby providing a second seal with respect to the wall 14. The counterflashing 60 is then positioned so that its channel-shaped lip 66 is inserted in the gap 68 formed at the entrance to the retaining channel 34. Pressure on the counterflashing 60 towards the wall 14 will cause the counterflashing upper lip to deform sufficiently so that it will pass through the retaining channel gap 68. Having passed through the gap 68, the counterflashing lip 66 will resume its original configuration, thereby resulting in the retaining ridge 36 preventing the counterflashing lip 66 from coming out.

Figure 2:
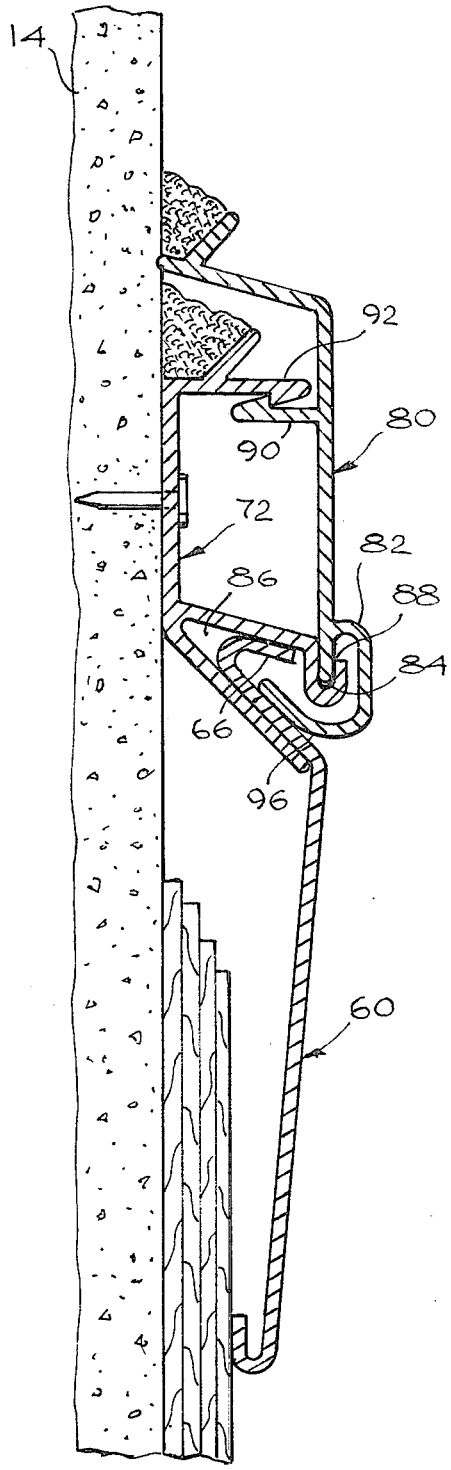
FIG. 2 is a cross-sectional view of a roof flashing system according to a second embodiment of the present invention.

A second embodiment according to the invention is shown in FIG. 2. A first reglet 72 is provided which is substantially identical to that of the previous embodiment. A second reglet 80 is also identical to the second reglet 12 of the first embodiment except that a downward extending holding band 82 is provided, one edge of which is connected near the lower edge 84 of the second reglet 80. The holding band 82 extends downwardly and is curved into a retaining channel 86 formed in the portion of the first reglet 72 as in the first embodiment.

In use, the only difference between the second and first embodiments is that the counterflashing upper lip 66 is positioned within the retaining channel 86 prior to attachment of the second reglet 80 to the first reglet 72. Placing the lower edge 84 of the second reglet 80 in a groove 88 which corresponds to the groove 30 of the first embodiment, and interlocking a medial flange 90 of the second reglet to an upper flange 92 of the first reglet 72 as in the first embodiment, results in a lower portion 96 of the downwardly extending holding band 82 to be in abutting contact with the inner surface of the counterflashing upper lip 66, thereby preventing the counterflashing upper lip 66 from slipping out of the retaining channel 86.

Thus as one can appreciate from the above, a roof flashing system has been described which comprises a means for forming a first longitudinally extending bead of caulking material along a wall, and then forming a second longitudinally extending bead of caulking material, the second bead being located above and substantially parallel to the first bead. The first bead is partially formed by a first reglet attached to the wall, and the second bead is partially formed by a second reglet attached to the first reglet. As one can now appreciate, the two reglet flashing system provided by the invention provides a sealing integrity not readily attainable by conventional roof flashing systems.

What is claimed is:

1. A roof flashing system comprising:

a first reglet attachable to a wall and forming a first longitudinally extending trough in conjunction with said wall for containment of a caulking compound; and a second reglet attachable to said first reglet and forming a second longitudinally extending trough in conjunction with said wall for containment of a caulking compound, said second trough being located substantially parallel to said first trough.

2. The system of claim 1 further comprising:

a longitudinally extending counterflashing; and means for holding said counterflashing in a predetermined relationship with respect to said first and second reglets.

3. The system of claim 2 in which one edge of said counterflashing forms a channel-shaped lip of resilient material, further comprising a retaining channel formed at the bottom of said first reglet and having a downward extending retaining ridge adapted to retain said counterflashing lip when deformably inserted into said retaining channel.

4. The system of claim 2 in which one edge of said counterflashing forms a channel-shaped lip, further comprising:

a retaining channel formed at the bottom of said first reglet and adapted to contain said counterflashing channel-shaped lip; and means for retaining said counterflashing lip in said retaining channel.

5. The system of claim 4 in which said means for retaining comprises a holding band one edge of which is attached to said second reglet and the other edge of which extends into said retaining channel and makes locking contact with said counterflashing lip.

6. A roof flashing system comprising:

a first extruded reglet comprising;

a vertical section for attachment to a wall;

an outwardly extending upper flange connected to the upper edge of said vertical section, said upper flange having a rib extending upwardly from its upper surface, said wall, upper flange and rib forming a first trough for containment of caulking compound, said upper flange unconnected edge forming an overhanging lip;

an outwardly extending lower flange connected at one edge to the lower edge of said vertical section and forming a groove at the other edge; and a second extruded reglet comprising;

a vertical member the bottom edge of which is adapted to fit into said first reglet groove;

an inwardly extending top flange connected to the top edge of said vertical member and having a rib extending upwardly from its upper surface, said wall, top flange and rib forming a second trough for containment of a caulking compound; and an inwardly extending medial flange connected to the inner surface of said vertical member, the unconnected edge of said medial flange adapted to make interlocking contact with said first reglet upper flange overhanging lip when said vertical member bottom edge is disposed within said first reglet groove, thereby causing said inwardly extending top flange to make abutting contact with said wall.

7. The flashing system of claim 6 further comprising:

a longitudinally extending counterflashing; and means for holding said counterflashing in a predetermined relationship with respect to said first and second reglets.

8. The system of claim 7 in which said counterflashing forms a channel-shaped lip at one edge and said means for holding comprises:

an outwardly extending retaining flange connected at one edge to said vertical section and forming an outward-opening retaining channel in conjunction with said lower flange; and means for retaining said counterflashing lip in said retaining channel.

9. The system of claim 8 in which said means for retaining comprises a holding band one edge of which is connected to said second reglet and the other edge of which extends into said retaining channel and makes locking contact with said counterflashing lip.

10. A method for applying flashing to a wall comprising the steps of:

attaching a first reglet forming a first trough in conjunction with said wall to said wall;

placing a caulking compound in said first trough;

attaching a second reglet forming a second trough in conjunction with said wall to said first reglet, said second trough being substantially parallel to said first trough; and placing a caulking compound in said second trough.

11. The method of claim 10 further comprising the step of attaching a counterflashing to said first and second reglet combination.

* * * * *